US007063570B1

(12) United States Patent
Coyle et al.

(10) Patent No.: US 7,063,570 B1
(45) Date of Patent: Jun. 20, 2006

(54) ELECTRICAL CONNECTOR AND COMPONENT PACKAGING ASSEMBLY

(75) Inventors: Brian J. Coyle, Orchard Park, NY (US); Frank J. Leitch, North Tonawanda, NY (US); Robert C. Gmerek, Burt, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/067,253

(22) Filed: Feb. 25, 2005

(51) Int. Cl.
*H01R 13/68* (2006.01)

(52) U.S. Cl. ..... 439/621

(58) Field of Classification Search ..... 439/621, 439/620, 622, 668, 490
See application file for complete search history.

(56) References Cited

U.S. PATENT DOCUMENTS

| | | | | |
|---|---|---|---|---|
| 3,381,179 | A | 4/1968 | Uhl | |
| 3,820,054 | A * | 6/1974 | Clewes et al. | 439/73 |
| 4,018,981 | A | 4/1977 | Hawkins | |
| 4,113,341 | A | 9/1978 | Hughes | |
| 4,116,524 | A * | 9/1978 | DeNigris et al. | 439/490 |
| 4,239,319 | A | 12/1980 | Gladd et al. | |
| 4,375,311 | A | 3/1983 | Feldman | |
| 4,386,818 | A | 6/1983 | Millhimes et al. | |
| 4,447,105 | A * | 5/1984 | Ruehl | 439/489 |
| 4,580,001 | A | 4/1986 | Hikami | |
| 4,606,597 | A * | 8/1986 | Bielefeld | 439/490 |
| 4,679,885 | A | 7/1987 | Nestor et al. | |
| 5,026,305 | A * | 6/1991 | Del Guidice et al. | 439/620 |
| 5,238,429 | A | 8/1993 | Margrave et al. | |
| 5,588,876 | A * | 12/1996 | Hayes et al. | 439/622 |
| 5,593,323 | A * | 1/1997 | Dernehl | 439/668 |
| 5,594,276 | A * | 1/1997 | Murari et al. | 257/693 |
| 5,647,761 | A * | 7/1997 | Kaminski | 439/419 |
| 5,810,622 | A * | 9/1998 | Chang | 439/622 |
| 6,109,973 | A * | 8/2000 | Gronowicz et al. | 439/620 |
| 6,144,283 | A * | 11/2000 | Matsumura | 337/198 |
| 6,190,207 | B1 * | 2/2001 | Wang | 439/622 |
| 6,273,729 | B1 * | 8/2001 | Kelly | 439/36 |
| 6,402,555 | B1 * | 6/2002 | Garcia et al. | 439/620 |
| 6,851,982 | B1 * | 2/2005 | Ku | 439/621 |

FOREIGN PATENT DOCUMENTS

| | | |
|---|---|---|
| GB | 944657 | 12/1963 |

* cited by examiner

*Primary Examiner*—Alexander Gilman
(74) *Attorney, Agent, or Firm*—Patrick M. Griffin

(57) ABSTRACT

An electrical connector assembly is employed for packaging an electrical component within the connector housing. The connector housing is substantially closed with an opening for receiving a mating connector along a predetermined line of insertion. First and second conductor elements are retained within the housing in spaced apart relationship. Each conductor element defines an electrical contact, which extends substantially parallel to the line of insertion for engaging mating contacts carried by the mating connector. One or more of the conductor elements define a terminal for receiving a lead from an associated electrical component. The lead receiving terminal is accessible through the housing opening. Means are provided for guiding and positioning the electrical component during the insertion process.

18 Claims, 5 Drawing Sheets

ELECTRICAL CONNECTOR AND COMPONENT PACKAGING ASSEMBLY

The present invention relates generally to the structural packaging of electrical components and the interfacing thereof within associated electrical circuits. More particularly, the present invention relates to methods of conveniently interconnecting standard electrical components within established electrical networks. More particularly still, the present invention relates to integration of discrete, serviceable electrical components as adjuncts within standard electrical connectors using terminals in such a way as to simultaneously mechanically lock the terminals to the package assembly.

BACKGROUND OF THE INVENTION

It is known to provide housings for electrical components and also provide a package including a housing receiving the component and a closure for covering the component after assembly. However, such packages require that the leads be assembled to the component either prior to assembly of the component and package, or simultaneously with such assembly. This requires that the assembled component and leads be assembled and subsequently handled as a unit as well as requiring that the lead length be predetermined.

It is often desirable for ease of handling and protection from the environment to package electrical components, such as diodes, resistors and the like in an assembly that houses the component, as well as making electrical connection with it. In such a package assembly, an insulating housing contains the component and also contains terminals to make electrical contact with leads of the component, and it is necessary to somehow retain those terminals in the housing.

Existing U.S. patents illustrate several examples of such packaging assemblies. For example, U.S. Pat. No. 4,018,981 to Hawkins discloses a packaging assembly with an insulating housing 12 that receives an electrical component 36. The housing 12 also includes passages that receive a pair of terminals 52, which make electrical contact with the component 36. The terminals 52 are mechanically locked into the housing 12 by projections 82 on a cover 16 hinged to part of the housing 12. When the cover is snapped into place, the projections 82 prevent the terminals 52 from being withdrawn. Although providing effective packaging, the Hawkins device is a dedicated structure, which does not lend itself to compact design and combination with other circuit elements.

U.S. Pat. No. 4,580,001 to Hikami shows a package device with an insulating body 1 having a cavity 3 that receives the body 4 of a component that has a pair of leads 8 extending out to the sides. After the component is in place, a pair of terminals 9 are pushed down into parallel grooves 2 on either side of the cavity 3 to make contact with the leads 8. In a separate operation, the terminals 9 are then bowed down so that tabs 13 thereon may be resiliently inserted into undercuts 5 in the grooves 2. A great drawback of this structure is that the package has to be disassembled, by taking the terminals 9 out, before the component can be removed. This is a great disadvantage if the component is one that may frequently need to be changed, like a diode in a current suppression device.

U.S. Pat. No. 4,679,885 to Nestor et al. discloses improved means for mechanically locking the terminals to the package assembly. A package assembly 10 defines a cavity 24, which receives an electrical component 12 such as a diode, which makes contact between a pair of terminals 20 and is affixed within slots 32 formed in terminal flanges 30. This locks the terminals 20 from removal from the housing 18. A cavity cover 34 is snap fitted to the housing 18 after the diode 12 has been installed to further protect the diode. The undersurface of the cover 34 engages the diode body to assure that it is properly seated within the cavity. The apparatus described by Nestor, although representing an improvement over prior designs, requires an extremely complex housing 18 configuration, which is expensive to tool and produce. The cover 34, being a separate part, can be misassembled or not included in a final assembly, leading to quality problems. The snap fit feature is not a robust design inasmuch as its integral engagement tabs can fail if subjected to abuse or frequent replacement of the diode 12. The housing design requires access from the side, which can present problems for installation and servicing, especially in applications where the housing 18 is incorporated within a larger structure. Complexity of shape and positioning of housing openings is also problematic for affecting a reliable environmental seal.

U.S. Pat. No. 4,386,818 to Millhimes et al. shows a two-piece connector 1 & 3 for battery jumper cables including a two state LED device 49 which provides a green light when the cables 5 & 7 are connected to a battery with polarity in the manner stated on the connector 1 & 3 and a red light when the polarity is reversed. The circuitry is contained in an indented upper section 35 having a pair of apertures 37 and 39 therein which extend into the hollow interior region 17. A pair of displacement contacts 41 and 43 are positioned in the apertures 37 and 39 respectively. A cover 55 closes the LED device 49 within the indented upper section 35. As in the case of the Nestor apparatus described herein above, the Millhimes apparatus employs a housing, which is complex and expensive to produce.

U.S. Pat. No. 4,239,319 to Gladd et al. discloses a diode package 10, which is interconnected between matable plug and socket connectors, 70 and 72, respectively, of wiring harnesses. The diode package 10 comprises a connector body 12 housing a subassembly 14 comprising a pair of hermaphroditic terminals 42 and 44 connected to the leads of a diode 43. The connector body has socket and plug portions 18 and 16, respectively, at opposite ends which are shaped to mate in an inverted relationship. The hermaphroditic terminals 42 and 44 are of opposite hand and each has box-like female and male blade contacts 46 and 48, respectively, at opposite ends which are shaped to mate in an inverted relationship. The Gladd device, although affording convenient mechanical insertion and removal from a host wiring harness, has shortcomings in certain applications. It adds axial length to the combined structure, which can raise packaging issues. It adds additional components and cost. It adds an additional set of contacts, which can contribute to system voltage drop and inter-contact corrosion, both of which can degrade overall system performance. The diode 43 is not independently serviceable inasmuch as its leads are permanently crimped at crimp barrels 52 and 54. This requires replacement of the entire diode package whenever service is required. Finally, it requires an additional plug/socket interface, providing a potential leak path for water or contaminants.

The present invention overcomes the forgoing difficulties of installing and servicing electrical components housed within connector assemblies by having a mating connector body and the electrical component access the same opening within the connector housing. The invention allows employing standard connector housing configurations with standard seals and interlocks without adding cost or complexity of design.

BRIEF DESCRIPTION OF THE INVENTION

The invention provides an integrated electrical connector and component packaging assembly that employs certain features of conventional electrical connector socket and plug configurations, seals, interconnecting snap tab systems and the like. It does not add to part count, cost or manufacturing complexity. It is extremely robust, application friendly and can be incorporated within wiring harnesses or integrated within larger system assemblies with limited service access requirements.

According to the present invention, an electrical connector assembly is employed for packaging an electrical component characterized by a body portion and at least one lead. The electrical connector assembly includes a substantially closed housing which defines a cavity therein and an opening adapted for receiving a mating connector body along a defined line of insertion. At least one conductor element is retained within the housing and defines an electrical contact which extends substantially parallel to the line of insertion, whereby, in application, it engages a mating contact carried by the mating connector body. The conductor element further defines a lead-receiving terminal located within the cavity and accessible through the opening for installation of the electrical component.

This arrangement has the advantage of employing the mating connector receiving opening in an electrical connector housing for installing and servicing an electrical component. Interconnection of the mating connector closes the housing and protects the electrical component from environmental hazards. Because the electrical component is installed and serviced in the same direction as the line of insertion of the mating connector, it can be installed late in the overall assembly process and serviced conveniently even when in the field. This is particularly advantageous in systems requiring the tailored suppression of radio frequency interference, where the selection of the optimal electronic component cannot be made until the system design is complete.

According to another aspect of the invention, the (electrical component) lead receiving terminal defines a lead receiving recess, which opens generally about an axis which is substantially parallel to the line of insertion and extends outwardly through said housing opening. This feature allows manipulation and installation of the electrical component in a single linear movement along the line of insertion, accommodating automated assembly for high volume applications.

According to another aspect of the invention, the lead receiving terminal(s) define lead insertion guide surfaces, which are disposed generally symmetrically about the terminal opening axis. This feature further facilitates automatic insertion of the electrical component.

According to still another aspect of the invention, positioning means are disposed within the housing cavity to engage the body portion of the electrical component for precise final positioning. This feature ensures close tolerance unit to unit repeatability during the manufacturing process and minimizes stresses on the component leads as they are affixed to their respective lead receiving terminals. In the preferred embodiment of the invention, the positioning means include a shaped surface adopted for abutting mating engagement with the outer surface of the electrical component body portion. This achieves nesting of the electrical component to minimize unit-loading forces during the assembly process.

Another related feature includes opposed resilient engagement members, which, in application, embrace and restrain unintended movement of the electrical component. Preferably, the resilient engagement members are integrally formed with the housing. This arrangement facilitates not only automatic insertion of the electrical component during the original manufacturing process, but also ensures that a replacement electrical device will be precisely positioned, even if inserted manually.

These and other features and advantages of this invention will become apparent upon reading the following specification, which, along with the drawings, describes and discloses preferred and alternative embodiments of the invention in detail.

DETAILED DESCRIPTION OF THE PREFERRED EMBODIMENT OF THE INVENTION

Figure 1:
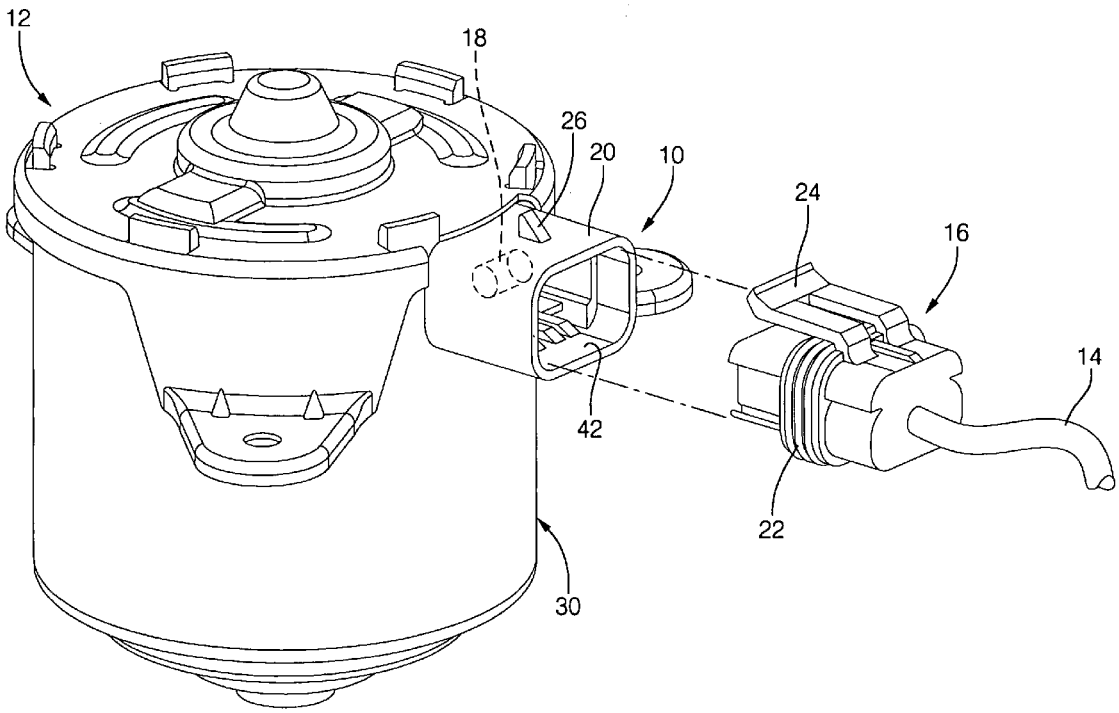
FIG. 1, is an exploded perspective view of a unified electrical connector and component packaging assembly in application with an electrical load and a mating electrical connector body.
Figure 2:
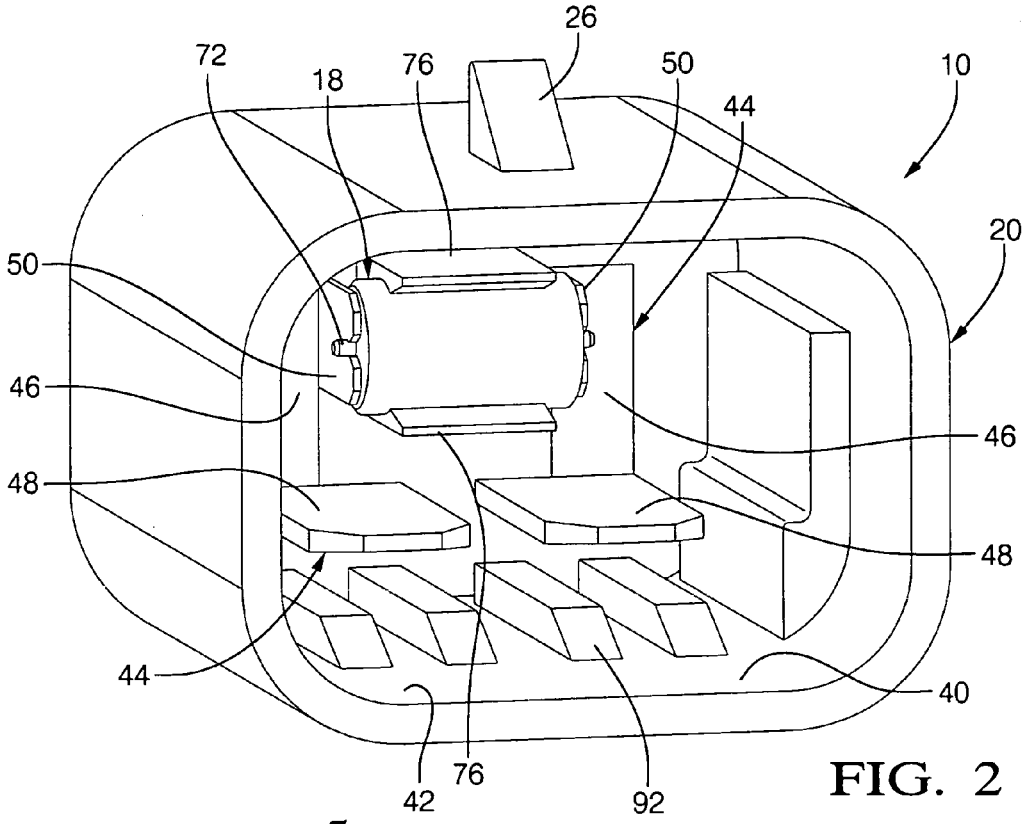
FIG. 2, is a perspective view, on an enlarged scale, of the internal structural detail of the electrical connector and component packaging assembly of FIG. 1.
Figure 3:
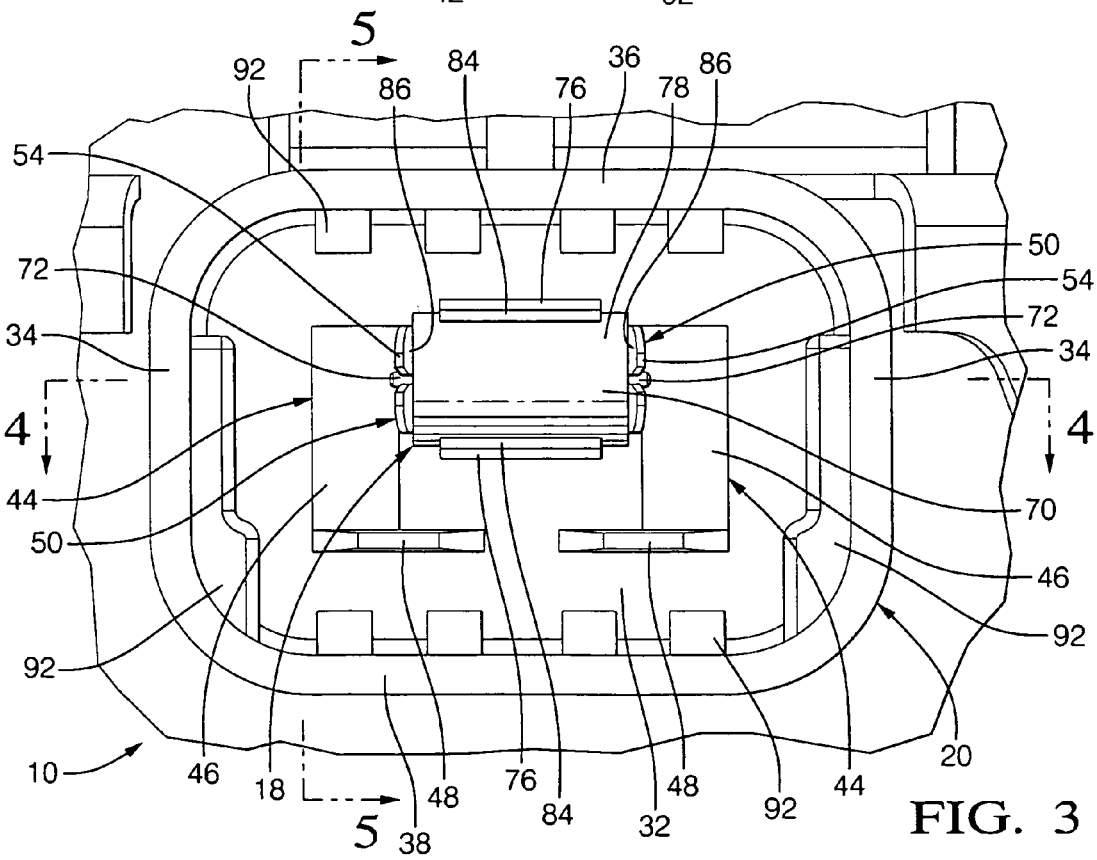
FIG. 3, is a front plan view, on a further enlarged scale, of the electrical connector and component packaging assembly of FIG. 2.

Referring to FIG. 1, an electrical connector assembly 10 is illustrated in application with an electrical load such as an automotive engine cooling fan motor 12. Motor 12 is in circuit with an electronic control module and/or power control module (not illustrated) via a wiring harness 14 terminated by a mating plug or connector 16.

In the contemplated environment for use of the present invention, motor 12 is part of a dual fan motor shroud assembly wherein the motors operate in series-parallel, allowing for multiple fan speed operation to optimize airflow characteristics as well as noise, vibration and harshness requirements for under-hood vehicle applications. Fan speed changes (low speed to high speed, high speed to low speed, and low speed to off) are typically effected by a relay and often generate a large voltage transient condition.

Large voltage transients are generated from energy stored in the motor's magnetic fields, which is released after opening the relay contacts. With the relay open, the stored energy cannot be dissipated by the motor and is emitted into the environment. Such emissions can cause other electrical signals to be momentarily interrupted, causing a hesitation or stoppage of operations of the host vehicle.

The addition of a diode 18 (illustrated in phantom) to the motor power/control circuit operates to suppress large voltage transients to a normal operating voltage level and provides a conductive path to the motor 12 until the excess voltage is consumed by the motor operations.

The packaging and incorporation of circuit elements for voltage transient and radio frequency interference suppression has historically been problematic. Typically a component and component connector are merely spliced into a system wiring harness at a convenient location with additional insulation and shielding. This approach frequently results in less than optimal positioning of the suppressing component, environmental contamination and production quality issues. Such sub-optimal positioning allows undesirable fugitive emissions to spread, thus creating a greater risk of electrical interference.

In the present invention, the diode 18 is housed within the housing 20 of the fan motor electrical connector assembly 10. The integral diode connector design allows for optimizing packaging space within the motor or electrical connector assembly 10 and avoids the need for external packaging, conductors or connectors. The integral wire connector uses largely existing connector infrastructure and connector seals 22 to provide a waterproof interface between the housing 20 and mating connector 16 to simultaneously protect the diode 18, the diode packaging and the electrical interconnections between the electrical connector assembly 10 and the mating connector 16.

The inventive design facilitates installation of the diode 18 during the original manufacturing process as well as post-assembly service and replacement while in the field during the life cycle of the host vehicle. Post-assembly access to the diode 18 is gained by releasing a snap-tab 24 carried on the mating connector 16 from engagement with its mating locking abutment 26, which is integrally formed on the external surface of housing 20 of the electrical connector assembly 10, and withdrawing the mating connector 16 in reverse direction along the original line of insertion from the electrical connector assembly 10.

By positioning the diode 18 adjacent the electrical conductors 28 emerging from the motor case 30 (refer FIGS. 2–5), the diode 18 maximizes the suppression of the transient voltage at the motor 12 and minimizes the risk of resulting electrical interference to host vehicle electrical operations.

A problem inherent to the design of complex electrical systems and computer architectures within modern automobiles is that the optimal electrical suppression components may not be known until near the end of the design cycle. The present invention facilitates the late selection and implementation of a specific optimized diode 18 without requiring wiring changes. The present invention is particularly advantageous in two motor engine-cooling systems as contemplated herein. In that case, both motors can be equipped with an electrical connector assembly 10. Then, the diode 18 can be properly specified with both motors. The motor 12 producing the emissions can be suppressed based on the switching operation that results in an interruption, whether the operation is high speed to low speed, low speed to high speed or low speed to off.

Referring to FIGS. 2–5, the internal structural detail of the electrical conductor assembly 10 is illustrated. Housing 20 is formed of electrically insulating injection molded material such as thermoplastic and includes a back wall portion 32, opposed side wall portions 34, top wall portion 36 and bottom wall portion 38. Wall portions 32, 34, 36 and 38 are integrally formed and substantially enclose a cavity 40 which is open to the exterior of housing 20 through a rightwardly directed (as viewed in FIG. 5) opening 42. Opening 42 is shaped and dimensioned to nestingly receive mating connector 16, including connector seals 22 along a line of insertion designated by arrow L. Although illustrated as a single straight line, a line of insertion could alternatively be segmented into multiple discrete straight offset segments and/or curvilinear segments. When installed within opening 42 of housing 20, mating connector 16 fully closes cavity 40, producing a substantially water tight seal.

Figure 5:
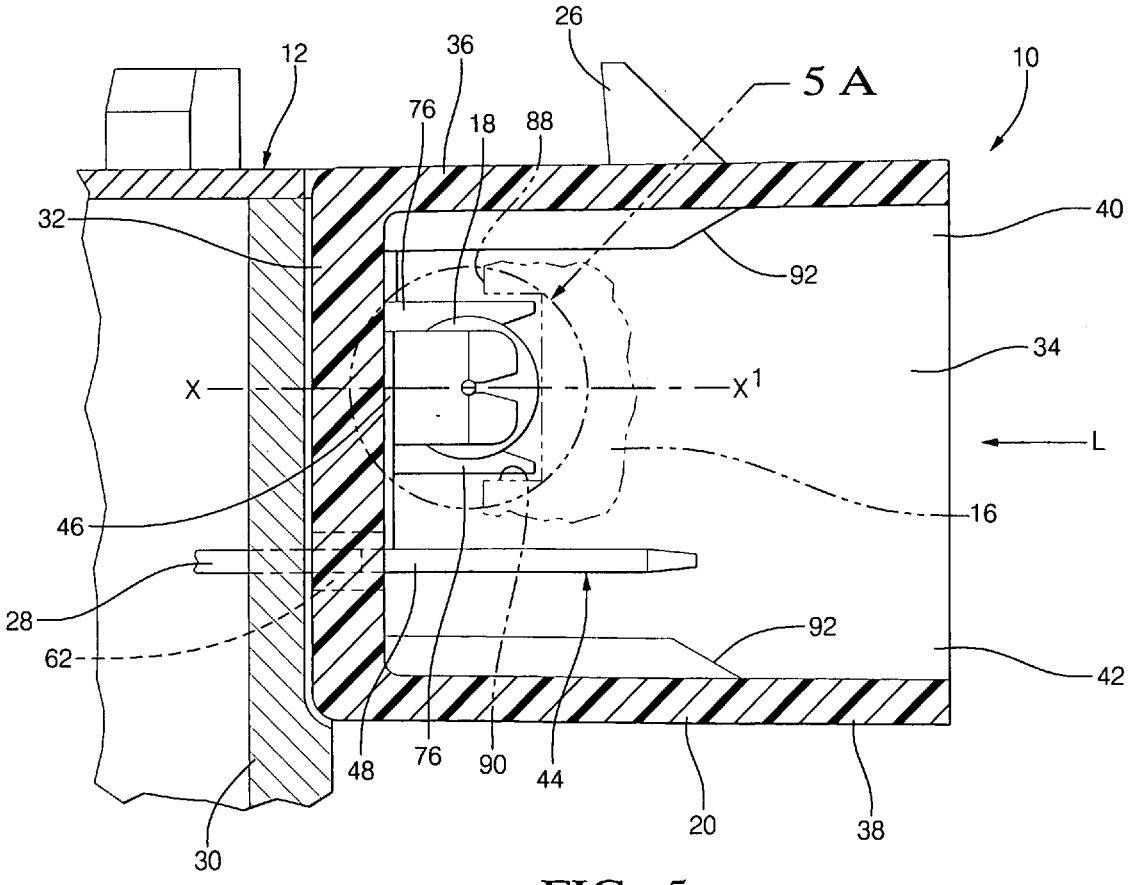
FIG. 5, is a side cross-sectional plan view of the electrical connector and component packaging assembly, taken on lines V—V of FIG. 3.

As viewed in FIG. 5, a conductor element 44, formed of electrically conductive material such as copper, tin or nickel-plated steel, includes a vertically directed base portion 46, which is affixed to back wall portion 32 of housing 20 such as by insert molding. Conductor element 44 includes an integral contact 48 such as a male spade-shaped terminal extending rightwardly toward opening 42 along a line of elongation substantially parallel to the line of insertion L. When mating connector 16 is fully installed within housing 20 of electrical connector assembly 10, wherein snap tab 24 rides up and over the ramp formed by locking abutment 26 to interconnect the two, male contact 48 is fully engaged with a mating female spade connector (not illustrated) carried within mating connector 16 and is in circuit with one of the conductors within wiring harness 14.

Figure 5A:
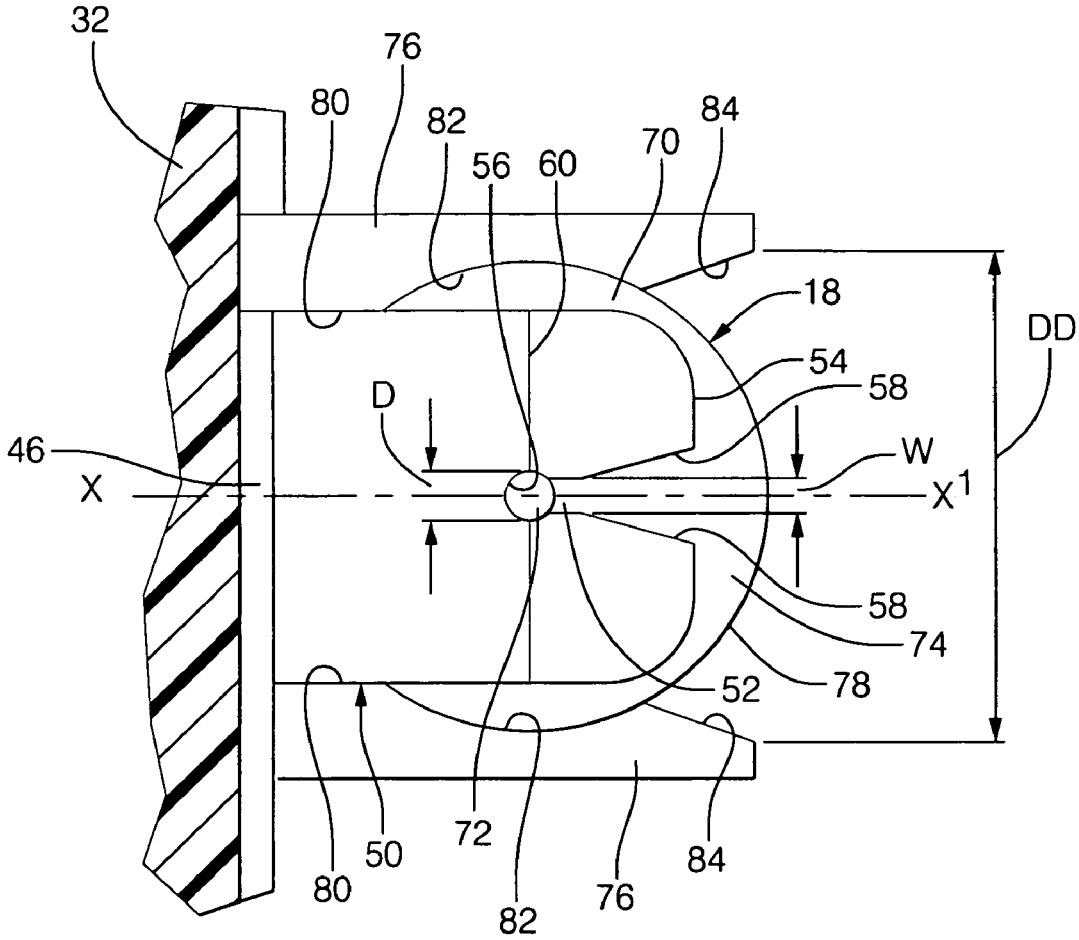
FIG. 5*a*, is a broken portion of the electrical connector and component packaging assembly of FIG. 5, on a greatly enlarged scale to highlight certain internal structural features.

As best viewed in FIG. 5*a*, an electrical component mounting clip 50 extends rightwardly from the upper end of base portion 46 of conductor element 44 towards opening 42. The free end of mounting clip 50 has a recess or slot 52 formed therein commencing at the mid-portion thereof and extending rightwardly to its endmost surface 54. Slot 52 is disposed about an axis of symmetry X-X' and has a nominal vertical width W terminating leftwardly in a semicircular pocket 56 having a nominal diameter D. Pocket 56 diameter dimension D is slightly greater than slot width dimension E. As slot 52 approaches endmost surface 54, it transitions into two opposed diverging guide surfaces 58.

Figure 4:
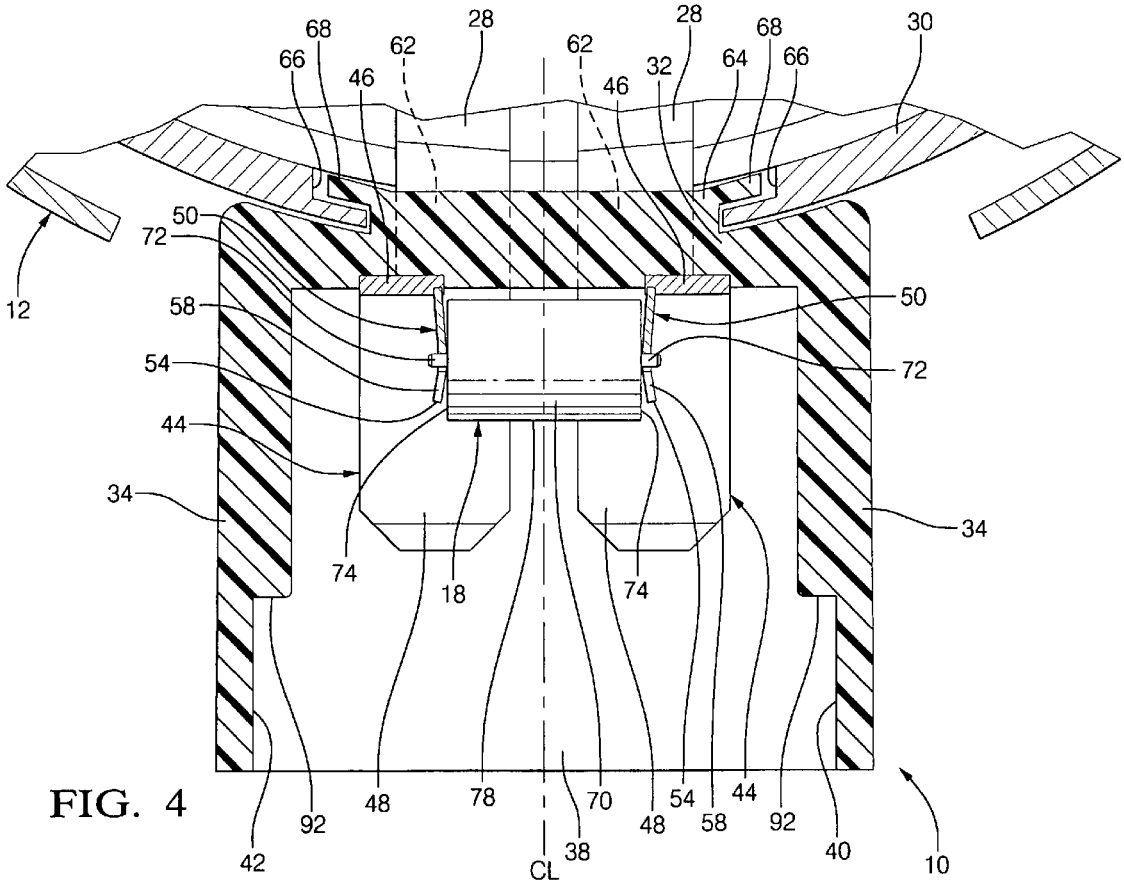
FIG. 4, is a top cross-sectional plan view of the electrical connector and component packaging assembly, taken on lines IV—IV of FIG. 3.

A vertical fold line 60 centered on semicircular pocket 56 bisects mounting clip 50. As best seen in FIGS. 4, 5 and 5A, the portion of mounting clip 50 disposed left of fold line 60 angles slightly inwardly (into the paper when viewing FIG. 5) and the portion of mounting clip 50 disposed right of fold line 60 angles slightly outwardly (out of the paper when viewing FIG. 5). Axis X-X' is parallel to line of insertion L.

An electrical buss connector 62 extends leftwardly from base portion 46 through back wall portion 32 of housing 20. Connector 62 electrically interconnects with motor conductor 28, which passes through motor case 30. As best seen in FIG. 4, the surface of back wall portion 32 adjacent motor case 30 has a thickened section 64 shaped to nest within a keyed pocket 66 in motor case 30. Thickened section 64 of back wall portion 32 forms an integral flange 68, which is disposed within pocket 66 of motor case 30 to affix the electrical connector assembly 10 and motor 12 in the orientation illustrated in FIG. 4.

As best viewed in FIG. 4, the electrical connector assembly 10 is substantially symmetrically arranged laterally about its centerline CL. Thus, the conductor element 44 described herein above has a mirror-image twin conductor element 44. The two conductor elements 44 are laterally spaced and electrically insulated from one another. The two integral contact spade connectors 48 provide the access point for electrical interconnection of the motor 12 with the remainder of the host vehicle electrical system via the mating connector 16 and wiring harness 14.

The conductor elements 44 are preferably formed from a single stamping whereby their respective base portions 46, contacts 48, electrical component mounting clips 50 and electrical buss connectors 62 are integrally formed to ensure against misassembly and the introduction of rogue resistances therein. It is contemplated, however, that the components of conductor elements 44 could be formed from discrete separate parts electrically interconnected by known means.

The base portion 46, contact 48 and electrical buss connector 62 of each conductor element 44 are formed with a relatively thick section and are relatively rigid. The electrical component mounting clips 50 have a somewhat thinner section and thus are relatively resilient in the lateral directions as best seen in FIG. 4.

An electrical component, such as diode 18 has a generally cylindrical body portion 70 and two opposed electrical leads 72 extending axially outwardly from respective end surfaces 74 of body portion 70. Body portion 70 has an outwardly facing cylindrical surface 78 extending axially between end surfaces 74 having a characteristic diameter DD Referring to FIGS. 5 and 5*a*, vertically opposed electrical component retention members 76 are integrally formed with back wall portion 32 of housing 20 and depend there from in cantilever fashion, extending rightwardly towards opening 42. Component retention members 76 are centered on centerline CL and extend laterally slightly less that the lateral spacing of the two opposed component mounting clips 50. The respective facing surfaces 80 of retention members 76 have symmetrically concave shaped surfaces 82 formed therein. The shaped surfaces 82 are formed at a constant radius substantially equaling one-half of the diode 18 body diameter DD. Furthermore, the shaped surfaces 82 are vertically spaced from one another by a dimension of slightly less than DD.

In application, as the diode 18 is inserted within housing 20 along the line of insertion L, electrical component mounting clips 50 act to laterally center the diode 18 while component retention members 76 act to vertically center the diode 18. As the diode 18 approaches its design intent position, the leads 72 are positioned by guide surfaces 58 to align the leads 72 with slots 52. Width dimension W of slots 52 is slightly less that the characteristic diameter if the leads 72 to ensure interference fit there between.

The converging laterally opposed surfaces of component mounting clips 50 (i.e. facing surfaces of mounting clips 50 located to the right of fold lines 60 as viewed in FIG. 5*a*) simultaneously resiliently bear against their respective end surfaces 74 of diode 18, further acting to laterally center the diode 18. Once in design intent location, the diode leads 72 are substantially aligned with the fold line 60 of the mounting clips 50 to continuously bear against the diode end surfaces 74.

As the diode 18 is displaced into its final design intent position, leads 72 traverse slots 52 and enter semicircular pocket 56. The interfit between the leads 72 and their respective pockets 56 remains tight to ensure a good electrical and mechanical connection. When installed, the diode 18 is in circuit with the motor 12 in anti-parallel relation therewith.

As the diode 18 is inserted, the retention members 76 simultaneously engage the outer circumferential surface 78 of the diode 18. Opposed, tapered leading surfaces 84 tend to rotate and guide the diode 18 as it approaches its final design intent position. Tapered surfaces 84 act against the circumferential outer surface 78 of the diode 18 to momentarily resiliently displace the free ends of retention members 76 away from one another as the diode 18 passes thereby. As the diode 18 becomes aligned with the respective shaped portions 82 of facing surfaces 80, the resilience of the displaced retention members 76 will urge the diode 18 into final alignment with the shaped portions 82. Thereafter, the retention members 76 will continuously resiliently grip the body portion 70 of the diode 18 to minimize inertial loading effects on the lead 72/mounting clip 50 interface. Simultaneously, laterally opposed surfaces 86 of mounting clips will resiliently press against diode end surfaces 74.

Once fully installed, the diode 18 is sealed within cavity 40 by insertion of mating connector 16 within opening 42 in housing 20 of electrical connector assembly 10. As best seen in FIG. 5, the leading edge 88 of the mating connector 16 has a pocket 90 formed therein which is aligned with the diode 18 and its associated packaging structure. Stop surfaces 92 are formed integrally with inside surfaces of housing 20 to limit insertion of mating connector 16 within housing 20. When fully inserted, the leading edge 88 of mating connector 16 is closely spaced from diode 18 to provide an extra degree of assurance that the diode 18 cannot, in application, be inadvertently dislodged from its intended design position.

It is to be understood that the invention has been described with reference to specific embodiments and variations to provide the features and advantages previously described and that the embodiments are susceptible of modification as will be apparent to those skilled in the art. For example, any number of connector configurations, either custom or standard can be modified to adopt the present invention. Furthermore, other types of suppression components such as resistors, capacitors, inductors and the like can be packaged in the same manner without departing from the spirit and intent of the present invention.

Furthermore, it is contemplated that many forms of electronic components with one, two, three or more leads can be employed depending upon the intended application. Accordingly, the forgoing is not to be construed in a limiting sense.

The invention has been described in an illustrative manner, and it is to be understood that the terminology, which has been used, is intended to be in the nature of words of description rather than of limitation.

Obviously, many modifications and variations of the present invention are possible in light of the above teachings. It is, therefore, to be understood that within the scope of the appended claims wherein reference numerals are merely for illustrative purposes and convenience and are not to be in any way deemed limiting, the invention which is defined by the following claims as interpreted according to the principles of patent law, including the Doctrine of Equivalents, may be practiced otherwise than as specifically described.

What is claimed is:

1. An electrical connector assembly for packaging an electrical component having a body portion and at least one lead, said electrical connector assembly comprising:

a substantially closed housing defining a cavity and an opening for receiving a mating connector body along a line of insertion;

at least one conductor element retained within said housing and defining an electrical contact extending substantially parallel to said line of insertion for engaging a mating contact carried by said mating connector body, said conductor element further defining a lead receiving terminal disposed within said cavity and accessible through said opening; and positioning means disposed within said cavity and operative to effect predetermined positional alignment of said electrical component with respect to said lead receiving terminal, wherein said positioning means defines opposed resilient engagement members operative, in application, to embrace an outer surface of said electrical component body portion.

2. The electrical connector assembly of claim 1, wherein said positioning means defines a shaped surface adapted for abutting mating engagement with an outer surface of said electrical component body portion.

3. The electrical connector assembly of claim 1, wherein said positioning means is integrally formed with said housing.

4. The electrical connector assembly of claim 1, wherein said conductor element defines means establishing a connection with an electrical conductor extending through a wall of said housing.

5. The electrical connector assembly of claim 1, wherein said lead receiving terminal defines a lead receiving recess opening about an axis extending substantially parallel to said line of insertion.

6. The electrical connector assembly of claim 5, wherein said lead receiving terminal defines converging lead insertion guide surfaces disposed generally symmetrically about said axis.

7. An electrical connector assembly for packaging an electrical component having a body portion and at least one lead, said electrical connector assembly comprising:

a substantially closed housing defining a cavity and an opening for receiving a mating connector body along a line of insertion;

first and second conductor elements retained within said housing in spaced-apart relationship, each conductor element defining an electrical contact extending substantially parallel to said line of insertion for engaging mating contacts carried by said mating connector body and at least one of said conductor elements defining an electrical component lead receiving terminal accessible through said opening; and means operative to effect predetermined positioning of said electrical component within said cavity, wherein said positioning means defines opposed resilient engagement members operative, in application, to embrace an outer surface of said electrical component body portion.

8. The electrical connector assembly of claim 7, wherein said electrical connector assembly is configured for packaging an electrical component having a body portion and at least two leads, and wherein both of said conductor elements define lead receiving terminals accessible through said opening.

9. The electrical connector assembly of claim 7, wherein at least one of said conductor elements define means establishing a connection with an electrical conductor extending through a wall of said housing.

10. The electrical connector assembly of claim 7, wherein said housing defines means to effect affixation of said package assembly to an electrical load.

11. The electrical connector assembly of claim 7, wherein said housing defines sealing surfaces circumscribing said opening for receiving a mating connector, said sealing surfaces operating to coact with mating surfaces on a mating connector body to effect an environmental seal therebetween.

12. The electrical connector assembly of claim 7, wherein said lead receiving terminal defines a lead receiving recess extending substantially parallel to said line of insertion.

13. An electrical connector assembly for packaging a discrete electrical component having a generally cylindrical body portion and at least two axially outwardly directed opposed leads, said electrical connector assembly comprising:

a substantially closed hosing defining a cavity and an opening for receiving a mating connector body along a line of insertion;

first and second conductor elements retained within said housing in laterally spaced apart relationship, each conductor element defining an electrical contact extending substantially parallel to said line of insertion for engaging a corresponding mating contact carried by said mating connector body, an electrical component lead receiving terminal accessible through said opening, and means for establishing a connection with an electrical conductor extending through a wall of said housing; and means operative to positionally retain the body portion of said electrical component between said conductor elements and dress the opposed leads for engagement with their respective lead receiving terminals, wherein said positioning means defines opposed resilient engagement members operative, in application, to embrace an outer surface of said electrical component body portion in a radial direction.

14. The electrical connector of claim 13, wherein said electrical component lead receiving terminals are axially spaced apart to capture and axially restrain the body portion of said electrical component.

15. The electrical connector of claim 13, further comprising means to effect fixation of said package assembly to an associated electrical load.

16. The electrical connector assembly of claim 13, wherein said electrical contact and electrical component lead receiving terminal are integrally formed within their respective conductor element.

17. An electrical connector assembly for establishing a circuit interconnection between a proximate electrical load and a source of electrical energy, said electrical connector assembly configured for packaging and placing in-circuit an electrical component having a body portion and at least two leads extending therefrom, said electrical connector assembly comprising:

a substantially closed housing adapted for mounting to an outer casing of said electrical load, said housing defining a cavity and an outwardly directed opening for receiving a mating connector body along a line of insertion, said mating connector body in-circuit with said electrical energy source;

first and second conductor elements retained within said housing in spaced-apart relationship, each conductor element defining an electrical contact extending substantially parallel to said line of insertion for engaging mating contacts carried by said mating connector body, and each conductor element further defining an electrical component lead receiving terminal accessible through said opening; and means disposed within said cavity intermediate said first and second conductor elements and operative to effect predetermined positioning of said electrical component within said cavity, wherein said positioning means defines opposed resilient engagement members operative, in application, to embrace an outer surface of said electrical component body portion.

18. An electrical connector assembly for packaging an electrical component having a body portion and at least one lead, said electrical connector assembly comprising:

a substantially closed housing defining a cavity and an opening for receiving a mating connector body;

at least one conductor element retained within said housing and defining an electrical contact for engaging a mating contact carried by said mating connector body, said conductor element further defining a lead receiving terminal disposed within said cavity and accessible through said opening; and positioning means including opposed resilient engagement members disposed within said cavity operative to embrace an outer surface of said electrical component body to effect predetermined positional alignment of said electrical component with respect to said lead receiving terminal.

* * * * *